United States Patent [19]

Fenton et al.

[11] Patent Number: 4,673,098

[45] Date of Patent: Jun. 16, 1987

[54] FUEL TANK VAPORIZATION AND EXPLOSION RESISTANT APPARATUS

[76] Inventors: Ronald L. Fenton, 465 Dominion Dr., Apt. 1208, Wood Dale, Ill. 60191; William C. Sames, 37W545 Mills Court, St. Charles, Ill. 60174

[21] Appl. No.: 899,716

[22] Filed: Aug. 25, 1986

[51] Int. Cl.[4] ..... B65D 25/00

[52] U.S. Cl. ..... 220/88 A; 222/189

[58] Field of Search ..... 222/189; 220/88 A; 122/4 R

[56] References Cited

U.S. PATENT DOCUMENTS 3,356,256 12/1967 Szego ..... 220/88 A
4,149,649 4/1979 Szego ..... 220/88 A

FOREIGN PATENT DOCUMENTS 8504128 2/1985 PCT Int'l Appl. ..... 220/88 A

*Primary Examiner*—Edward G. Favors
*Attorney, Agent, or Firm*—Douglas B. White

[57] ABSTRACT

There is provided a closed storage vessel having a heat conductive mesh-like interior affixed to the shell of the tank in secure heat conductive contact.

7 Claims, 1 Drawing Figure

FUEL TANK VAPORIZATION AND EXPLOSION RESISTANT APPARATUS

BACKGROUND OF THE INVENTION

The present invention relates generally to tanks for liquefied fuel gas such as propane or liquefied petroleum gas (LPG) and methods for controlling the temperature and vaporization of the liquid fuel within the tank. In a typical propane or LPG tank there is generally encountered a metallic tank member designed to contain the fuel under pressure and having a valve at one end to access the contents thereof. Typically, this tank is filled substantially with propane or liquid petroleum gas. During normal operation the liquid fuel is vaporized under ambient heat to provide an operating pressure under which the vapor is withdrawn through the tank valve. As vapor is withdrawn the remaining liquid vaporizes and in so doing absorbs heat known as the latent heat of vaporization. This causes the temperature of the remaining liquid to decrease, which in turn reduces the ability of the remaining liquid to vaporize. Consequently, the pressure of the system continues to fall as a result of the declining liquid temperature due to withdrawal of the vapor. Since the heat loss due to the vaporization of the liquid must be replaced from the heat in the environment surrounding the container, the tank will exhibit decreased function until the liquid temperature is raised.

In the case of fire, where heat is applied locally to the tank, the liquid proximate the hot spot will boil and increase the vapor pressure within the tank. This pressure increase will quickly overwhelm any typical pressure relief valve and cause an explosion. Prior attempts to neutralize the explosion tendencies of the tank have included providing an expanded aluminum mesh within the tank, but this has been ineffective since it compresses during use and does not maintain conductive contact with the tank shell. Likewise, it will not enhance the vaporization under ambient conditions since heat is inefficiently conducted from the shell.

SUMMARY OF THE INVENTION

Accordingly, it is an object of the present invention to provide an improved fuel tank which exhibits improved explosion protection while also improving the efficiency and operation. Generally there is provided a closed storage vessel having a heat conductive mesh-like interior affixed to the shell of the tank in secure heat conductive contact.

Other objects and advantages of the invention will become apparent upon reading the following detailed description and upon reference to the drawings.

Figure 1:
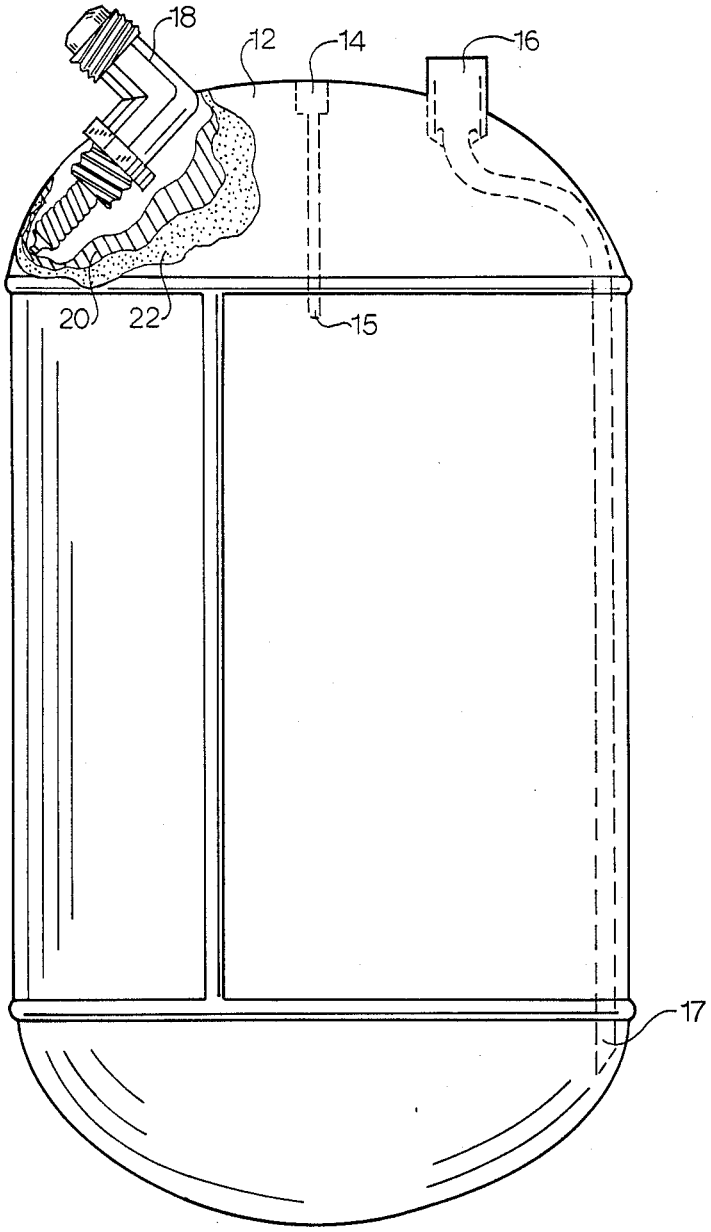
FIG. 1 is an elevational view partially cut away of a fuel tank of the present invention.

While the invention will be described in connection with the preferred embodiment, it will be understood that it is not the intent to limit the invention to that embodiment. On the contrary, it is the intent to cover all alternatives, modifications and equivalents as may be included within the spirit and scope of the invention as defined by the appended claims.

DESCRIPTION OF THE PREFERRED EMBODIMENT

Referring to FIG. 1 there is shown a fuel tank of the type usable with the preferred embodiment of the present invention having an outer enclosing member 12, and having affixed to its one extremity a dip pipe 14 arranged to detect the level of fuel in the tank when used in a horizontal manner, and having a fill/draw connection 16 to provide access to the liquid fuel through the inner tank extension 17. In normal vertical operation, liquid stored in the tank vaporizes and accumulates in the uppermost portion of the tank whereupon it is withdrawn as needed through any standard connection (not shown) in the tank top. In conventional systems, the vaporization of the liquid is dependent upon the heat available from the external environment through the tank wall 12. Under periods of excessive use, the temperature of the liquid will be reduced to a point where this vaporization becomes limited which will in turn limit the amount of vaporized fuel available for consumption.

In accordance with the apparatus of the present invention, there is provided within the tank, and particularly within the liquid filled portion of the tank, a heat conductive member 20 arranged to conduct heat from the external wall 12 of the tank member and distribute the heat throughout the liquid containing portion of the tank chamber. In the preferred embodiment of the present invention, this filler 20 would be formed as a metallic lattice shaped sheet rolled to conform to the confines of the tank and adhered to the tank shell by adhesive 22. Satisfactory results have been obtained with EC776 adhesive manufactured by 3M Corporation. This adhesive prevents separation of the metallic filler from the tank shell and ensures heat conductive contact.

In this arrangement the volume of the liquid filled portion of the tank is criss-crossed by numerous metallic foils. While the total volume of the tank is reduced to some extent, considerable volume is retained by using thin foils in this lattice network.

Technically, this apparatus increases the "wetted surface" of the tank. Generally, the greater the wetted surface of the tank, the greater the amount of vaporization capacity of the system. Consequently, a larger container, having a larger wetted surface area, would have a greater vaporizing capacity. By incorporating the apparatus of the present invention, providing the filler described above, an increase in the wetted surface is achieved without changing the size or dimensions of the tank.

Explosion protection is uniquely provided by this same system which improves vaporization. When a local hot spot occurs on the tank shell, the heat will dissipate through the liquid and localized boiling will be avoided. The adhesive contact of the filler to the tank allows dissipation of applied heat before the liquid temperature rises to a boiling condition.

In a further aspect of the present invention, there is provided a relief valve 18 strategically positioned within said tank to provide its internal extremity at the uppermost portion of the tank when the tank is used in the horizontal mode. This ensures that the pressure relief valve accesses the vapor in all conditions and will not be covered by liquid fuel. When localized boiling does occur, the valve prevents tank explosion by releasing pressure.

We claim:

1. An improved tank apparatus for liquid fuel storage comprising:

a closed tank member having means for selective access to the contents of said tank; and a heat conductive filler within said tank attached in heat conductive contact with said tank member for transmitting heat by conduction from said tank member to the liquid.

2. The tank apparatus of claim 1 wherein said heat conductive filler is affixed to portions of said tank member by adhesive.

3. The tank apparatus of claim 2 wherein said heat conductive filler comprises a metallic foil member.

4. The tank apparatus of claim 3 wherein said metallic foil member forms a lattice configuration.

5. The tank apparatus of claim 3 wherein said metallic foil member is comprised of a rolled lattice sheet configuration.

6. The tank apparatus of claim 3 wherein said metallic foil member is comprised of multiple layers of a lattice sheet configuration.

7. The tank apparatus of claim 3 further comprising a pressure relief valve positioned at one side of said tank and having an internal extremity thereof projecting toward the uppermost portion of said tank.

* * * * *